US008872842B2

(12) United States Patent
Fujino

(10) Patent No.: US 8,872,842 B2
(45) Date of Patent: Oct. 28, 2014

(54) DISPLAY DEVICE AND ELECTRONICS APPARATUS

(75) Inventor: Yuusuke Fujino, Kanagawa (JP)

(73) Assignee: Sony Corporation, Tokyo (JP)

( * ) Notice: Subject to any disclaimer, the term of this patent is extended or adjusted under 35 U.S.C. 154(b) by 437 days.

(21) Appl. No.: 13/408,620

(22) Filed: Feb. 29, 2012

(65) Prior Publication Data

US 2012/0236016 A1 Sep. 20, 2012

(30) Foreign Application Priority Data

Mar. 15, 2011 (JP) ..... 2011-056690

(51) Int. Cl.

| | |
|---|---|
| ***G09G 5/02*** | (2006.01) |
| ***G09G 3/32*** | (2006.01) |
| *G09G 5/06* | (2006.01) |

(52) U.S. Cl.

CPC ..... *G09G 3/3241* (2013.01); *G09G 2320/0242* (2013.01); *G09G 5/06* (2013.01); *G09G 2300/0452* (2013.01)

USPC ..... 345/603

(58) Field of Classification Search

None

See application file for complete search history.

(56) References Cited

U.S. PATENT DOCUMENTS

2006/0262053 A1* 11/2006 Lee et al. ..... 345/76
2011/0292087 A1* 12/2011 Lim ..... 345/690

FOREIGN PATENT DOCUMENTS

| | | |
|---|---|---|
| JP | 02-118521 | 5/1990 |
| JP | 04-54207 | 8/1992 |
| JP | 2008-107507 | 5/2008 |
| JP | 2009-500654 | 1/2009 |
| JP | 4434935 | 1/2010 |
| JP | 4494808 | 4/2010 |

* cited by examiner

*Primary Examiner* — Xiao Wu
*Assistant Examiner* — Yingchun He
(74) *Attorney, Agent, or Firm* — Rader, Fishman, Grauer PLLC

(57) ABSTRACT

A display device includes:

a display unit having plural pixels each including red (R), green (G), and blue (B) sub-pixels, and a color (Z) sub-pixel whose luminance is higher than luminances of the above three sub-pixels; a conversion processing unit for generating output image signals corresponding to the colors R, G, B, and Z by performing predetermined processing using input image signals corresponding to the colors R, G, and B; and a drive unit with the conversion processing unit for performing display driving on the four sub-pixels, wherein the conversion processing unit generates the output image signals for performing display operation in the four sub-pixels if the luminance level of the Z sub-pixel is higher than a predetermined threshold; and generates the output image signals for performing the display operation in the R, G, and B sub-pixels, but not in the Z sub-pixel if not higher.

11 Claims, 11 Drawing Sheets

DISPLAY DEVICE AND ELECTRONICS APPARATUS

BACKGROUND

The present disclosure relates to display devices having a sub-pixel structure in which each pixel includes four color sub-pixels that are, for example, a red (R) sub-pixel, a green (G) sub-pixel, a blue (B) sub-pixel, and a white (W) sub-pixel, and to electronics apparatuses equipped with such display devices.

One of the most typical methods for displaying color images used in a display device equipped with plural pixels is a method in which three sub-pixels that correspond to three primary colors, that is, R (red), G (green), and B (blue) one-by-one are disposed in each pixel, and the luminance level of each sub-pixel is individually adjusted.

With the use of this method, it is possible to arbitrary set the chromaticity point and luminance level of an entirety of a pixel, and a color image can be displayed.

An example of a display device capable of displaying color images using such a method is a liquid crystal display device. This type of liquid crystal display device typically includes a backlight device that emits a white light and a liquid crystal panel having R, G, and B color filters that are respectively provided for an R sub-pixel, a G sub-pixel, and a B sub-pixel. In addition, usually polarization plates are disposed at the entrance side and exit side of this type of liquid crystal panel. Therefore, the intensity of emitted light from the backlight device is typically decreased owing to the polarization plates and the color filters, and the light utilization factor through the entirety of the liquid crystal device becomes less than ten percent. As a result, a large amount of energy is needlessly lost in the liquid crystal display device, which leads to an increase in electricity consumption.

In order to reduce the electricity consumption when a liquid crystal display device is displaying images, a liquid crystal panel equipped with pixels each of which includes four color sub-pixels has been proposed (For example, refer to Japanese Examined Patent Application Publication No. 4-54207). Concretely speaking, these four color sub-pixels are three R, G, and B color sub-pixels, and one Z color sub-pixel (for example, a white (W) or yellow (Y) sub-pixel) whose luminance is higher than the luminances of the above three sub-pixels. Luminance efficiency can be further increased and electricity consumption can be further lowered in the case where images are displayed using image signals corresponding to such four color sub-pixels compared with the case where images are displayed by supplying image signals corresponding to the three R, G, and B colors to each pixel having an existing sub-pixel structure composed of R, G, and B sub-pixels.

In addition to the above-described liquid crystal display device, an example of a display device having a sub-pixel structure in which each pixel includes R, G, B, and Z color sub-pixels is an organic EL (electroluminescence) display device with a self-emitting function (Refer to Japanese Patent No. 4434935, for example). In addition, a method (a method of color conversion processing (RGB/RGBZ conversion processing)), in which output image signals corresponding to four colors R, G, B, and Z are generated on the basis of input image signals corresponding to three R, G, and B colors, is proposed, for example, in Japanese Unexamined Patent Application Publication No. 2008-107507, Japanese Unexamined Patent Application Publication (Translation of PCT Application) No. 2009-500654, and Japanese Patent No. 4494808.

SUMMARY

In such cases as cited above, it is typical that, while the above-described R, G, and B sub-pixels are provided with color filters, a color filter is not provided for the Z sub-pixel in order for the Z sub-pixel to show a high luminance (to increase the light utilization factor), or a filter with a high transmission factor used for adjusting a chromaticity point is provided for the Z sub-pixel. Therefore, in the Z sub-pixel (for example, in the W sub-pixel), there is a problem in that a chromaticity point varies in accordance with the change in the emitting luminance level of the Z sub-pixel. If such a chromaticity point variation occurs, the displayed color also varies.

To put it concretely, firstly, if a white light emitting element is formed in a W sub-pixel, for example, it may be difficult to ensure that an emitting wavelength range supplied by one emitting material (emitting layer) covers the entirety of the white color range. Therefore, a method is usually employed in which plural emitting layers that have emitting wavelength ranges (emitting colors) different from each other are disposed along the in-plane direction in a pixel, or are disposed so as to be stacked, and all these plural emitting layers are driven so as to emit lights at the same time. Particularly in the case of an organic EL element, it is typical that plural emitting layers are formed so that these layers are stacked. However, in such a case in which a white light emitting element is formed using plural emitting layers that have emitting colors different from each other, it is not easy to keep an emitting ratio of each emitting layer constant through the entirety of the emitting luminance levels of each emitting layer. Actually, the chromaticity point of the white light emitting element varies in accordance with the change of the emitting luminance level. Because, typically, as described above, the W sub-pixel is not provided with a color filter, such a chromaticity point variation in this white color emitting element directly leads to chromaticity variation in image display, which brings about a deterioration in image quality.

To solve this problem concerning the chromaticity point variation in the white color sub-pixel, a method in which predetermined chromaticity compensation is performed on image signals corresponding to R, G, B, and W one-by-one after color-conversions are performed on the image signals is proposed in the above Japanese Examined Patent Application Publication No. 4-54207. However, in this method, because many signal processing operations using many types of lookup table (LUT) have to be performed (used) when the chromaticity compensation is performed, there arise problems in that the signal processing load increases, the amount of electricity consumption increases, and the cost of manufacturing display devices increases.

As described above, in the existing methods, in the case where each pixel includes four R, G, B, and Z color sub-pixels, it may be difficult to bring images of high quality into shape while the increase in the load of signal processing is suppressed, therefore a method to cope with these problems has been desired.

The present disclosure is achieved with the above-described problems in mind, and provides a display device equipped with pixels each including a sub-pixel structure having four R, G, B, and Z color sub-pixels, and makes it possible for the display device to bring images of high quality into shape while suppressing the increase of the load in signal processing when the display device displays images, and provides an electronics apparatus equipped with the above display device.

A display device according to an embodiment of the present disclosure includes: a display unit that has plural pixels each including three color sub-pixels, that is, a red (R) sub-pixel, a green (G) sub-pixel, and a blue (B) sub-pixel, and a color (Z) sub-pixel whose luminance is higher than luminances of the above three sub-pixels; a conversion processing unit that generates output image signals corresponding to the four colors R, G, B, and Z one-by-one by performing predetermined processing on the basis of input image signals corresponding to the three colors R, G, and B one-by-one; and a drive unit that is equipped with the conversion processing unit and performs display driving on the R sub-pixel, G sub-pixel, B sub-pixel, and Z sub-pixel using the output image signals. In this case, the conversion processing unit generates the output image signals so that display operation is respectively performed in the R, G, B, and Z sub-pixels if the luminance level of the Z sub-pixel is higher than a predetermined threshold; and generates the output image signals so that the display operation is performed respectively in the R, G, and B sub-pixels, but the display operation is not performed in the Z sub-pixel if the luminance level of the Z sub-pixel is equal to or lower than the predetermined threshold.

An electronics apparatus according to the embodiment of the present disclosure is an apparatus equipped with the above-described display device.

In the display device and electronics apparatus according to the embodiment of the present disclosure, output image signals corresponding to the four colors R, G, B, and Z are generated one-by-one by performing predetermined processing on the basis of input image signals corresponding to the three colors R, G, and B one-by-one, and display driving is performed on the R, G, B, and Z sub-pixels using these output image signals. In this case, the output image signals are generated so that display operation is respectively performed in the R, G, B, and Z sub-pixels if the luminance level of the Z sub-pixel is higher than a predetermined threshold. Here, even if the luminance level of this Z sub-pixel varies, a chromaticity variation amount relative to a relevant variation amount of the emitting luminance level is small in the range of the high luminance level of the Z sub-pixel. Therefore, even if existing complicated chromaticity compensation is not performed, the increase of the chromaticity variation can be suppressed when images are displayed using the four R, G, B, and Z color sub-pixels (the chromaticity variation amount can be limited to a small amount). On the other hand, if the luminance level of the Z sub-pixel is equal to or lower than the predetermined threshold, output image signals are generated so that the display operation is performed respectively in the R, G, and B sub-pixels, but the display operation is not performed in the Z sub-pixels. In other words, in the range of the low luminance level of the Z sub-pixel where, if the luminance level of the Z sub-pixel varies, a chromaticity variation amount relative to a relevant variation amount of the emitting luminance level becomes large, images are displayed using the three R, G, and B color sub-pixels. Therefore, in the display device and electronics apparatus according to the embodiment of the present disclosure, while it is not necessary to perform color conversion processing accompanied by complex chromaticity compensation, images can be displayed without using four R, G, B, and Z color sub-pixels, but using the three R, G, and B color sub-pixels in the range of the low luminance level of the Z sub-pixel. In this case, the sufficient reduction of electricity consumption can be realized when considering the electricity consumed at the luminance levels of the four sub-pixels as a whole.

In the display device and electronics apparatus according to the embodiment of the present disclosure, when output image signals corresponding to the four colors R, G, B, and Z are generated on the basis of input image signals corresponding to the three colors R, G, B, if the luminance level of the Z sub-pixel is higher than a predetermined threshold, output image signals are generated so that display operation is respectively performed in the R, G, B, and Z sub-pixels; and if the luminance level of the Z sub-pixel is equal to or lower than the predetermined threshold, output image signals are generated so that the display operation is performed respectively in the R, G, and B sub-pixels, but the display operation in the Z sub-pixel is not performed. Therefore, the increase of the chromaticity variation at the time of image display can be suppressed without performing complex processing (chromaticity compensation or color conversion processing). Therefore, in the case where images are displayed using pixels each having a sub-pixel structure composed of four R, G, B, and Z sub-pixels, it becomes possible that images of high quality are brought into shape while the increase of the load of signal processing is suppressed, and at the same time electricity consumption can be more lowered than in the case where images are displayed using pixels each having a sub-pixel structure composed of the four R, G, and B sub-pixels.

DETAILED DESCRIPTION OF EMBODIMENTS

Embodiments of the present disclosure will be described with reference to the accompanying drawings hereinafter. Descriptions about the embodiments will be made regarding the following subjects in this order.

1. Embodiments of the present disclosure (Examples in which each pixel has a sub-pixel structure including a R sub-pixel, a G sub-pixel, a B sub-pixel, and a W sub-pixel)
2. Modified examples of the present disclosure (Examples in which each pixel has a sub-pixel structure including a R sub-pixel, a G sub-pixel, a B sub-pixel, and a Y sub-pixel)
3. Modules and application examples thereof
4. Other modified examples <Embodiments of Present Disclosure>

[Configuration of Display Device 1]

Figure 1:
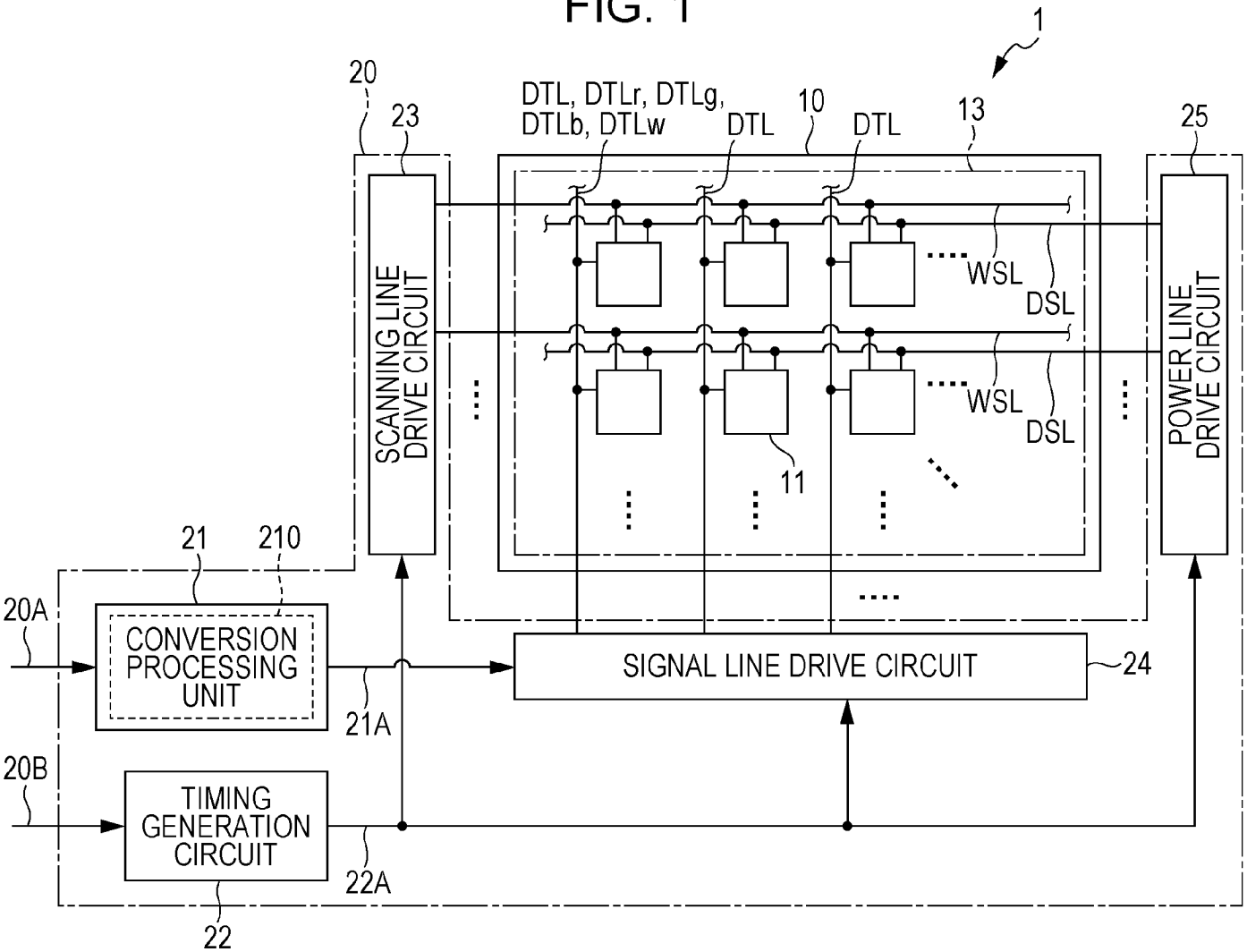
FIG. 1 is a block diagram showing an example of a display device according to an embodiment of the present disclosure.

FIG. 1 is a block diagram showing a schematic configuration of a display device according to an embodiment of the present disclosure (display device 1). This display device includes a display panel 10 (display unit) and a drive circuit 20 (drive unit).

(Display Panel 10)

The display panel 10 includes a pixel array unit 13 in which plural pixels 11 are disposed in a matrix configuration, and displays an image by performing active matrix driving on the basis of an image signal 20A and a sync signal 20B that are obtained from outside. Each pixel 11 includes plural sub-pixels corresponding to plural colors (four colors in this case).

The pixel array unit 13 includes plural scanning lines WSL disposed horizontally, plural signal lines DTL disposed vertically, and plural power lines DSL disposed in parallel with the scanning lines WSL. One end of each scanning line WSL, one end of each signal line DTL, and one end of each power line DSL are connected to the drive circuit 20, which will be described in detail later. In addition, the above-mentioned pixels 11 exist on intersections of scanning lines WSL and signal lines DTL, and these pixels are disposed in a matrix configuration. Here, one signal line DTL represents a group of plural signal lines composed of a signal line DTLr, a signal line DTLg, a signal line DTLrb, and a signal line DTLw. The plural signal lines DTLr, DTLG, DTLb, and DTLw, which correspond to plural colors, will be described in detail later.

Figure 2A:
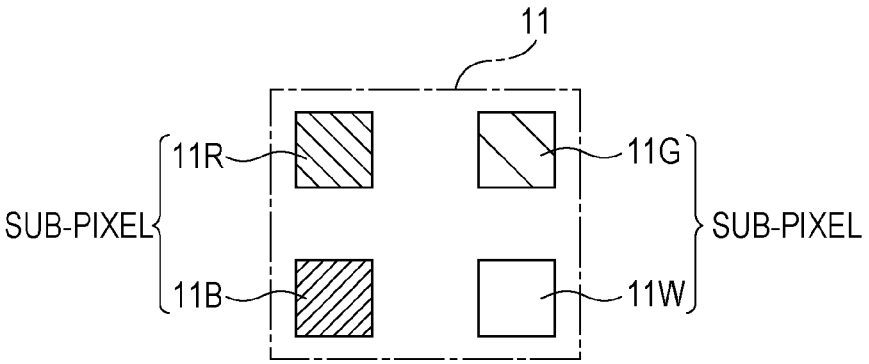
FIG. 2A is a schematic diagram showing an example of a sub-pixel structure in one pixel shown in FIG. 1.

FIG. 2A is a plan view that schematically shows an example of an internal configuration (sub-pixel structure) in a pixel 11.

Figure 2B:
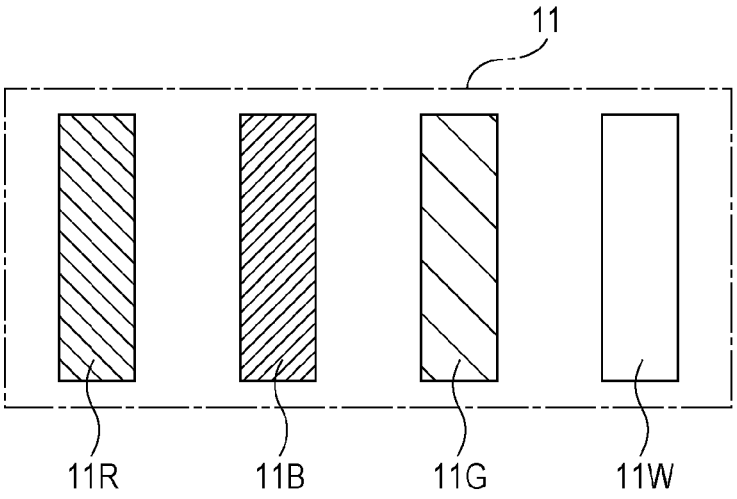
FIG. 2B is a schematic diagram showing another example of a sub-pixel structure in one pixel shown in FIG. 1.

FIG. 2B is a plan view that schematically shows another example of an internal configuration (sub-pixel structure) in a pixel 11.

As shown in FIG. 2A or in FIG. 2B, each pixel 11 includes three primary-color sub-pixels, that is, a red (R) sub-pixel 11R, a green (G) sub-pixel 11G, a blue (B) sub-pixel 11B, and one color Z sub-pixel 11W (in this case, a white (W) sub-pixel) whose luminance is higher than luminances of the above three sub-pixels. In other words, each pixel 11 has a sub-pixel structure composed of four sub-pixels 11R, 11G, 11B, and 11W corresponding to four colors R, G, B, and W, respectively. In an example shown in FIG. 2A, four sub-pixels 11R, 11G, 11B, and 11W are disposed in a matrix configuration (2-by-2 matrix configuration) in a pixel 11. In an example shown in FIG. 2B, the four sub-pixels 11R, 11G, 11B, and 11W are disposed in a row configuration in a pixel. However, a configuration in which the four sub-pixels 11R, 11G, 11B, and 11W are disposed in a pixel 11 is not limited to the above configurations, and it can be any other configuration.

In addition, a signal line DTLr, a scanning line WSL, and a light emission control line DSL are connected to a sub-pixel 11R (not shown in FIG. 2A nor in FIG. 2B). A signal line DTLb, a scanning line WSL, and a light emission control line DSL are connected to a sub-pixel 11B. A signal line DTLg, a scanning line WSL, and a light emission control line DSL are connected to a sub-pixel 11G. A signal line DTLw, a scanning line WSL, and a light emission control line DSL are connected to a sub-pixel 11W. In other words, the signal lines DTLr, DTLb, DTLg, and DTLw, which respectively correspond to colors red, blue, green, and white, are respectively connected to the sub-pixels 11R, 11B, 11G, and 11W, while the scanning line WSL and power line DSL are connected to the above sub-pixels in common.

Figure 3:
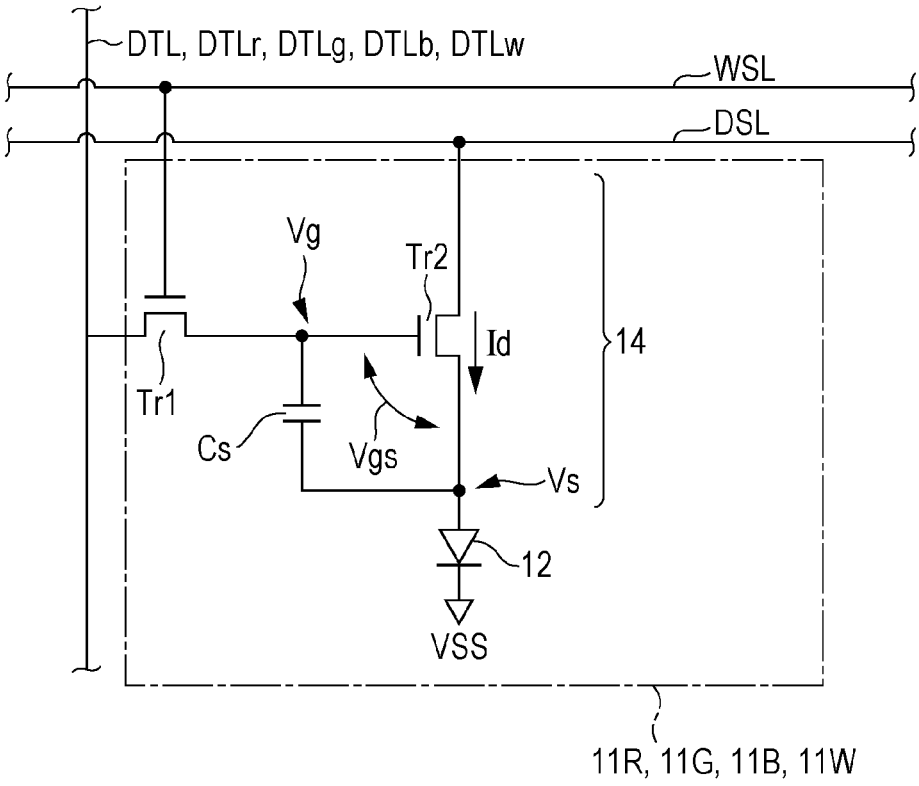
FIG. 3 is a circuit diagram showing an example of an internal configuration of one sub-pixel shown in FIG. 2A or FIG. 2B.

FIG. 3 shows an example of an internal configuration (circuit configuration) of any of the sub-pixels 11R, 11B, 11G, and 11W. Each of the sub-pixels 11R, 11G, 11B, and 11W includes an organic EL element 12 (emitting element) and a pixel circuit 14.

The pixel circuit 14 includes a write transistor Tr1 (used for sampling), a drive transistor Tr2, and a capacitive storage element Cs. In other words, this pixel circuit 14 has a so-called "2Tr1C" circuit configuration. In this circuit, it will be assumed that each of the write transistor Tr1 and the drive transistor Tr2 are TFTs (thin film transistors) of n-channel MOS (metal oxide semiconductor) type. Here, the type of TFT used for this circuit is not limited to this n-channel MOS type, and it can be, for example, an inversely staggered structure (so-called bottom-gate) type, or a staggered structure (so called top-gate) type.

In the pixel circuit 14, the gate of the write transistor Tr1 is connected to the scanning line WSL, and the drain is connected to the signal line DTL (DTLr, DTLg, DTLb, and DTLw), and the source is connected to the gate of the drive transistor Tr2 and one terminal of the capacitive storage element Cs. The drain of the drive transistor Tr2 is connected to the power line DSL, and the source is connected to the other terminal of the capacitive storage element Cs and the anode of the organic EL element 12. The cathode of the organic EL element 12 is set at a fixed potential VSS (for example, a ground potential).

Figure 4:
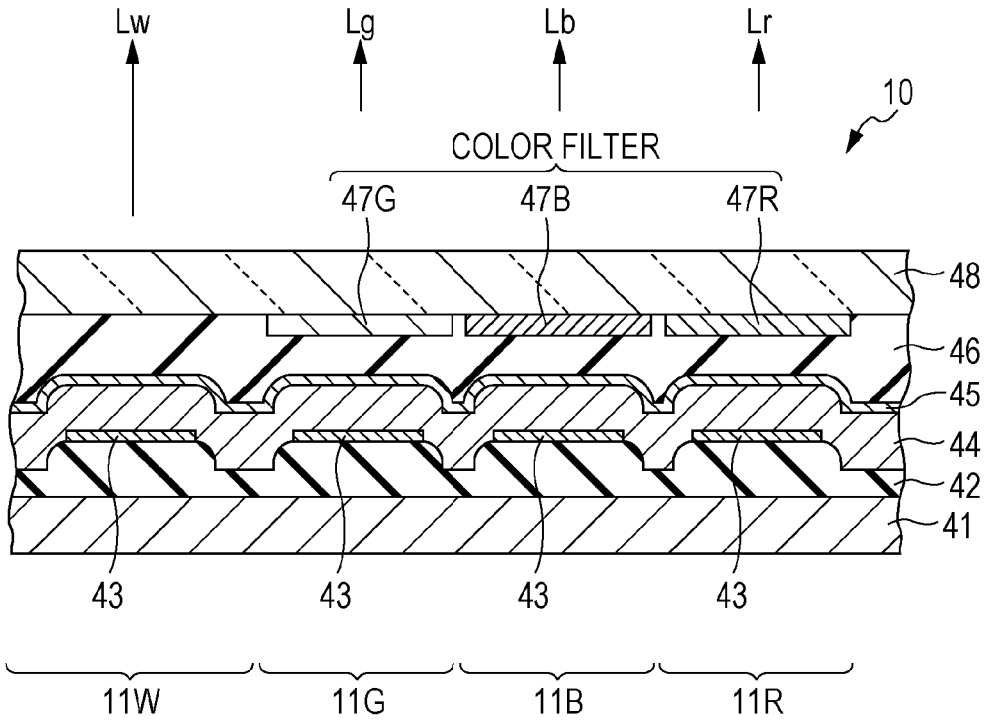
FIG. 4 is a schematic diagram showing an example of a cross-section view of one sub-pixel shown in FIG. 2A or FIG. 2B.

FIG. 4 is a diagram schematically showing an example of a cross-section of the configuration of the display panel 10 in which the sub-pixels 11R, 11G, 11B, and 11W are included. This display panel 10 includes a substrate 41, an insulating layer 42, lower electrodes 43, an organic layer 44, an upper layer 45, an insulating layer 46, color filters 47R, 47G, 47B, and an encapsulating substrate 48 from the rear face (back face) to the front face in this order.

The substrate 41 is a semiconductor substrate such as a silicon (Si) substrate, a glass substrate, or a resin substrate, and drive elements (not shown in FIG. 4), such as write transistors Tr1, drive transistors Tr2, capacitive storage elements Cs, and the like, are fabricated on the substrate 41. The insulating layer 42 functions as a passivation film for the above-mentioned drive elements, and is made of, for example, silicon oxide ($SiO_2$), or silicon nitride (SiN).

The lower electrodes 43 function as anode electrodes in this case, and one lower electrode 43 is provided for each of the sub-pixels 11R, 11G, 11B, and 11W. Because, as described later, the display panel 10 is a top surface emission type (so-called top emission type) display panel, the lower electrodes 43 are made of a material that has a high optical reflectance for an emitted light (a white light Lw in this case) emitted from the organic EL element 12 (for example, silver (Ag)). The organic layer 44 has a laminated structure composed of an emitting layer from which the white light is emitted (a later-described white light emitting layer 441W), and, for example, a hole injection layer, a hole transport layer, an electron injection layer, and an electron transport layer (none of the layers are shown in FIG. 4). The upper electrode 45 functions as a cathode electrode, and is shared by the sub-pixels 11R, 11G, 11B, and 11W. This upper electrode 45 is a transparent electrode made of a material that has a high optical transmission factor for the emitted light (white light Lw in this case) emitted from the organic EL element 12 (for example, ITO (indium tin oxide)). The above-described organic EL elements 12 are composed of these lower electrodes 43, the organic layer 44, and the upper electrode 45.

Figure 5A:
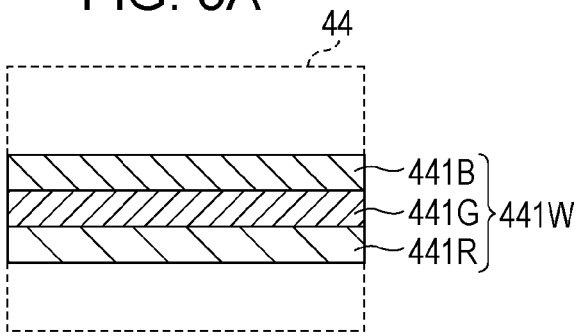
FIG. 5A is a schematic diagram showing an example of a detailed cross-section configuration of an organic layer shown in FIG. 4.
Figure 5B:
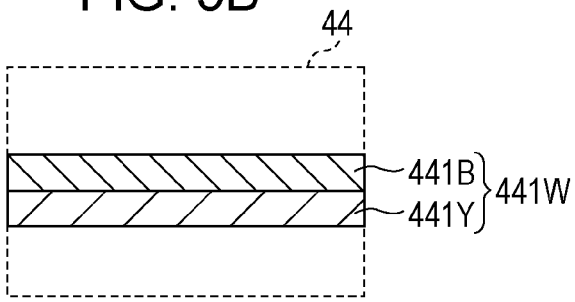
FIG. 5B is a schematic diagram showing another example of a detailed cross-section configuration of an organic layer shown in FIG. 4.

Here, the above-mentioned organic layer 44 includes a white light emitting layer 441W having plural emitting layers each of which has a different emitting color as shown in FIG. 5A or FIG. 5B. To put it concretely, an example of the organic layer 44 shown in FIG. 5A includes the white light emitting layer 441W composed of a red light emitting layer 441R, a green light emitting layer 441G, and a blue light emitting layer 441B that are stacked from the rear face to the front face in this order (so-called tandem structure). On the other hand, an example of the organic layer 44 shown in FIG. 5B includes the white light emitting layer 441W composed of a yellow light emitting layer 441Y and a blue light emitting layer 441B that are stacked from the rear face to the front face in this order. The white light emitting layers 441W are configured as described above in FIG. 5A and FIG. 5B, and the white light emitting layers 441W are formed so as to emit the white light Lw through simultaneous light emission by these plural light emitting layers.

The insulating layer 46 functions as an encapsulating layer, and it is made of, for example, silicon oxide ($SiO_2$), or silicon nitride (SiN). The encapsulating substrate 48 is a substrate that encapsulates the entirety of the display panel 10, and it is made of a transparent material such as glass.

The color filters 47R, 47G, and 47B are respectively disposed for sub-pixels 11R, 11G, and 11B. To put it concretely, the color filter 47R that selectively transmits a red light Lr is disposed for the sub-pixel 11R; the color filter 47G that selectively transmits a green light Lg is disposed for the sub-pixel 11G; and the color filter 47B that selectively transmits a blue light Lb is disposed for the sub-pixel 11B. As a result, the red light Lr, green light Lg, and blue light Lb that compose the white light Lw emitted from the organic layer 44 (organic EL element 12) are respectively transmitted and emitted as display lights through the sub-pixels 11R, 11G, and 11B on an elective basis. On the other hand, no color filter is disposed for the sub-pixel 11W, therefore the white light Lw emitted from the organic layer 44 (organic EL element 12) is transmitted and emitted as a display light through the sub-pixel 11W as is. Alternatively, a filter that transmits a large proportion of the white light Lw or a color filter with a high transmission factor used for adjusting the chromaticity point of the white light Lw to a desired white point can be provided for the sub-pixel 11W.

Although the above descriptions have been made under the assumption that the display panel 10 is of the top surface emission type, the display panel 10 is not limited to this type. For example, the display panel 10 can be of the bottom surface emission type (so-called bottom emission type). In addition, although the above descriptions have been made under the assumption that the lower electrodes 43 function as anode electrodes and the upper electrode 45 functions as a cathode electrode, similar descriptions can be made under the assumption that the lower electrodes 43 function as cathode electrodes and the upper electrode 45 functions as an anode electrode.

(Drive Circuit 20)

The drive circuit 20 shown in FIG. 1 drives the pixel array unit 13 (display panel 10), that is, performs display driving on the pixel array unit 13. To put it concretely, the drive circuit 20 performs display driving on plural pixels 11 by sequentially selecting plural pixels 11 of the pixel array unit 13, and respectively applying image signal voltages based on the image signal 20A to sub-pixels 11R, 11G, 11B, and 11W of the selected pixel 11. In other words, the drive circuit 20 performs display driving on the sub-pixels 11R, 11G, 11B, and 11W on the basis of the image signal 20A. This drive circuit 20 includes an image signal processing circuit 21, a timing generation circuit 22, a scanning line drive circuit 23, a signal line drive circuit 24, and a power line drive circuit 25.

The image signal processing circuit 21 performs predetermined image signal processing on the digital image signal 20A obtained from outside, and outputs an image signal 21A, which is generated after the predetermined image signal processing has been performed on the digital image signal 20A, to the signal line drive circuit 24. This predetermined image signal processing includes, for example, gamma correction processing and overdrive processing.

This image signal processing circuit 21 includes a conversion processing unit 210 that performs predetermined conversion processing (RGB/RGBW conversion processing). This conversion processing unit 210 generates output signals corresponding to the four colors R, G, B, and W by performing the above RGB/RGBW conversion processing on the basis of input image signals corresponding to the three colors R, G, and B. Such a conversion processing unit 210 as this is composed of, for example, plural multipliers and adders. The detailed operation (details of the conversion processing) of this conversion processing unit 210 will be described later (with reference to FIG. 6A, FIG. 6B, and FIG. 7).

The timing generation circuit 22 generates a control signal 22A on the basis of a sync signal 20B obtained from outside, and outputs the control signal 22A, which controls the scanning line drive circuit 23, the signal line drive circuit 24, and the power line drive circuit 25 so that these circuits can operate in conjunction with each other.

The scanning line drive circuit 23 sequentially applies a selection pulse to plural scanning lines WSL in accordance with (in synchronization with) the control signal 22A in order to sequentially select plural pixels 11. To put it concretely, the scanning line drive circuit 23 generates the selection pulse by selectively outputting a voltage Von that turns on the write transistor Tr1 and a voltage Voff that turns off the write transistor Tr1. Here, the value of the voltage Von is set to be larger than the value of the on-voltage of the write transistor Tr1 (a constant value), and the value of the voltage Voff is set to be smaller than the value of the on-voltage of the write transistor Tr1 (a constant value).

The signal line drive circuit 24 generates an analog image signal corresponding to the image signal 21A sent from the image signal processing circuit 21 in accordance with (in synchronization with) the control signal 22A, and respectively applies this analog signal to the signal line DTL (DTLr, DTLg, DTLb, and DTLw). To put it concretely, the signal line drive circuit 24 respectively applies analog image signal voltages for individual colors based on the image signal 21A to the signal lines DTLr, DTLg, DTLb, and DTLw. As a result, the image signal is written into the sub-pixels 11R, 11G, 11B, and 11W of the pixel 11 selected by the scanning line drive circuit 23. Here, writing the image signal into the sub-pixels means that, after each of the above image signal voltages is programmed for the relevant capacitive storage element Cs, a predetermined voltage is applied between the gate and the source of the relevant drive transistor Tr2.

The power line drive circuit 25 sequentially applies control pulses to the plural power lines DSL in accordance with (in synchronization with) the control signal 22A in order to control the emission (lighting) operations and extinction (quenching) operations of the organic EL elements 12 in the sub-pixels 11R, 11G, 11B, and 11W of each pixel 11. In other words, the lengths of light emitting periods and light extinguishing periods of the sub-pixels 11R, 11G, 11B, and 11W in each pixel 11 can be controlled by adjusting the width of the control pulse, that is, by performing PWM (pulse width modulation) on the control pulse.

[Effects and Advantages of Display Device 1]

(Fundamental Behaviors)

In this display device 1, as shown in FIG. 1 to FIG. 3, the drive circuit 20 performs display driving on (each of sub-pixels 11R, 11G, 11B, and 11W of) each pixel 11 in the display panel 10 (pixel array unit 13) on the basis of the image signal 20A and the sync signal 20B. As a result, as shown in FIG. 4, FIG. 5A, and FIG. 5B, a driving current is injected into an organic EL element 12 in each of sub-pixels 11R, 11G, 11B, and 11W, and because hole-electron recombination occurs in the emitting layer (white light emission layer 441W in this case) of the organic layer 44, emission (white light emission in this case) occurs. In the sub-pixel 11W, the emitted light (white light Lw in this case) emitted from the white light emitting layer 441W is emitted as is as a display light through the top surface (of the encapsulating substrate 48). On the other hand, the white light Lw emitted from the white light emitting layer 441W is transmitted through the color filters 47R, 47*g*, and 47B in the sub-pixels 11R, 11G, and 11B respectively, with the result that the white light is converted to the red light Lr, green light Lg, and blue light Lb, and these lights are respectively emitted as display lights through the top surface of the encapsulating substrate 48. In such a way, an image is displayed in the display panel) 10 on the basis of the image signal 20A.

In this embodiment of the present disclosure, as described above, an image is displayed using image signals corresponding to four color sub-pixels 11R, 11G, 11B, and 11W. Luminance efficiency can be further increased and electricity consumption can be further lowered in the above case compared with an existing case where images are displayed using image signals corresponding to three R, G, and B color sub-pixels.

The write operation of an image signal performed in each of sub-pixels 11R, 11G, 11B, and 11W will be described with reference to FIG. 2A, FIG. 2B, and FIG. 3 hereinafter. It will be assumed that, during a time period when the image signal voltages are applied to a signal line DTL, and the voltage of the power line DSL is set to be a voltage VH (that is, to be in a "H (high)" state), the scanning line drive circuit 23 raises the voltage of the scanning line WSL from the voltage Voff to the voltage Von. In this case, because the write transistor Tr1 is turned on, the gate potential Vg of the drive transistor Tr2 rises to an image signal voltage corresponding to the relevant voltage among the voltages of the signal line DTL. As a result, the image signal voltage is applied to the capacitive storage element Cs and is stored by the capacitive storage element Cs.

At this stage, because the anode voltage of the organic EL element 12 is smaller than the sum of the threshold voltage Vel of the organic EL element 12 and the cathode voltage Vca of the organic EL element 12 (=VSS), the organic EL element 12 is in an off-state. In other words, at this stage, a current does not flow through the anode and cathode of the organic EL element 12 (that is, the organic EL element 12 does not emit light). Therefore, a current Id supplied from the transistor Tr2 flows into a capacitive element (not shown in FIG. 3) existing between the anode and cathode of the organic EL element 12, and this capacitive element is charged with the current Id.

Next, during a time period when the voltages of the signal line DTL are kept equal to the image signal voltages, and the voltage of the power line DSL is kept at the voltage VH (that is, to be in the "H" state), the scanning line drive circuit 23 reduces the voltage of the scanning line WSL from the voltage Von to the voltage Voff. As a result, because the write transistor Tr1 is turned off, the gate of the drive transistor Tr2 enters a floating state. In this case, the voltage Vgs between the gate and source of the drive transistor Tr2 is held constant, therefore the current Id flows through the drain and source of the drive transistor Tr2. As a result, the source potential Vs of the drive transistor Tr2 increases, at the same time the gate potential Vg of the drive transistor Tr2 also increases owing to capacitive coupling via the capacitive storage element Cs. Therefore, the anode voltage of the organic EL element 12 becomes larger than the sum of the threshold voltage Vel of the organic EL element 12 and the cathode voltage Vca of the organic EL element 12. Consequently, the current Id, which corresponds to an image signal voltage stored in the capacitive storage element, that is, a voltage Vgs between the gate and source of the drive transistor Tr2, flows through the anode and source of the organic EL element 12, with the result that the organic EL element 12 emits light with a desired luminance level.

Next, the drive circuit 20 causes a light emitting period of the organic EL element 12 to stop after a predetermined time period elapses. To put it concretely, the power line drive circuit 25 reduces the voltage of the power line DSL from the voltage VH to the voltage VL (that is, from the "H" state to the "L (low)" state). As a result, the source voltage Vs of the drive transistor Tr2 decreases, and the anode voltage of the organic EL element 12 becomes smaller than the sum of the threshold voltage Vel of the organic EL element 12 and the cathode voltage Vca of the organic EL element 12, with the result that the current Id stops flowing through the anode and cathode of the organic EL element 12. Consequently, the organic EL element 12 stops emitting light (the organic EL element 12 enters a light extinguishing period). In the above-described way, it is possible to determine the length of the light emitting period for each of the sub-pixels 11R, 11G, 11B, and 11W of a pixel 11 using the width of a control pulse applied to the power line DSL (that is, the length of the period of the control pulse being in the "H" state).

The drive circuit 20 performs display driving so that a combination of the above-described light emitting operation and light extinguishing operation is periodically repeated on a one combination per frame (one vertical period (V period) basis. In addition to the above operation, the drive circuit 20 scans the power lines DSL by applying control pulses and scans the scanning lines by applying selection pulses in the row direction for, for example, every one horizontal period (H period). Display operation (display driving performed by the drive circuit 20) in the display device 1 is performed in the above-described way.

(Effects Brought about by Distinctive Functions)

Next, effects brought about by distinctive functions of the display device 1 according to this embodiment will be described in detail.

First, as described above, in the case where images (color images) are displayed using a sub-pixel structure composed of four sub-pixels 11R, 11G, 11B, and 11W, there arises the following problem if the sub-pixel structure is an existing one. To put it in detail, the problem is the fact that a chromaticity point varies in accordance with the change of an emitting luminance level in the sub-pixel 11W.

To put it concretely, first, if a white light emitting element is formed in a sub-pixel 11W, it may be difficult that an emitting wavelength range supplied by a single emitting material (emitting layer) covers the entirety of the white color range. Therefore, as described above, a method is usually employed in which plural emitting layers that have emitting wavelength ranges (emitting colors) different from each other's emitting wavelength range are disposed along the in-plane direction in a pixel, or disposed so as to be laminated, and all these plural emitting layers are driven to emit light at the same time. However, in such a case in which a white light emitting element is formed using plural emitting layers that have different emitting wavelength ranges, it is not easy to keep an emitting ratio of each emitting layer (of the above-described red emitting layer 441R, green emitting layer 441G, blue emitting layer 441B, yellow emitting layer 441Y, and the like) constant throughout the entirety of the emitting luminance level. Actually, the chromaticity point of the white light emitting element varies in accordance with the change of the emitting luminance level. Because, as described above, any color filter is not provided to the sub-pixel 11W, such a chromaticity point variation in this white color emitting element directly leads to the chromaticity variation in image display, which brings about a deterioration in image quality.

To solve this problem concerning the chromaticity point variation in the white color sub-pixel 11W, a method, in which predetermined chromaticity compensation is respectively performed on the image signals corresponding to the R, G, B, and W sub-pixels after color-conversions are performed on the image signals, has been proposed. However, in this method, because many pieces of signal processing using many types of lookup tables (LUTs) have to be used stepwise when the chromaticity compensation is performed, the load of signal processing increases, the amount of electricity consumption increases, and the cost of manufacturing the display device increases.

In the display device 1 according to this embodiment, the conversion processing unit 210 generates output image signals corresponding to four colors of R, G, B, and W on the basis of input image signals corresponding to three colors of R, G, and B by performing conversion processing (RGB/RGBW conversion processing) that will be described in detail hereinafter. To put it concretely, first, the conversion processing unit 210 generates the output image signals so that display operation is respectively performed in the sub-pixels 11R, 11G, 11B, and 11W if the luminance level (light emitting luminance level) of the sub-pixel 11W is higher than a predetermined threshold A. On the other hand, if the luminance level of the sub-pixel 11W is equal to or lower than the predetermined threshold A, the conversion processing unit 210 generates the output image signals so that the display operation is performed respectively in the R, G, and B sub-pixels 11R, 11G, and 11B, but the display operation is not performed in the sub-pixel 11W. As described above, the conversion processing unit 210 according to this embodiment does not perform chromaticity compensation on an image signal corresponding to the sub-pixel 11W in the RGB/RGBW conversion processing.

Figure 6A:
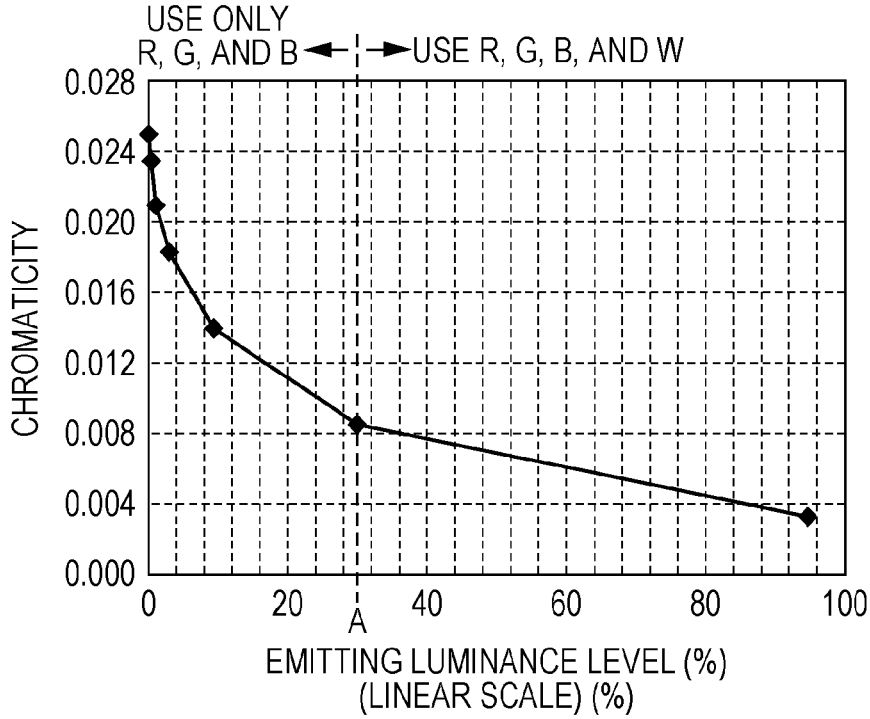
FIGS. 6A and 6B are characteristic diagrams showing a relationship between an emitting luminance level and chromaticity according to the embodiment of the present disclosure with the x-axis scale being a linear scale and a logarithmic scale, respectively.
Figure 6B:
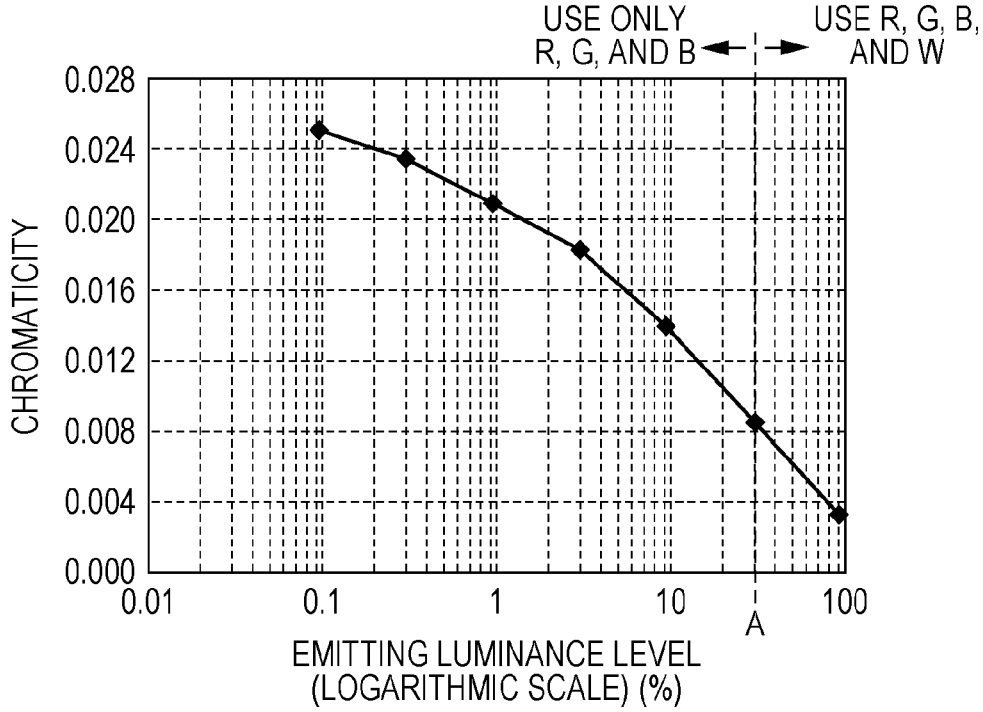

Here, as shown in an embodiment example in FIG. 6A and FIG. 6B, the threshold A is set so that a chromaticity variation amount corresponding to a chromaticity point at the time when the sub-pixel 11W shows the maximum luminance level is within a predetermined range (for example, the chromaticity variation amount is between 0.004 and 0.008 at $\Delta u'v'$). In other words, it is preferable that a range where the emitting luminance level is larger than this threshold A (that is, the range within which the display operation is performed in each of sub-pixels 11R, 11G, 11B, and 11W) is set within the predetermined range including the above maximum luminance level.

As described above, in the case where the luminance level in the sub-pixel 11W is larger than the predetermined threshold A, an output image signal is generated so that the display operation is performed in each of the sub-pixels 11R, 11G, 11B, and 11W, with the result that the following effect is brought about. First, as shown in FIG. 6A and FIG. 6B, in the range where the emitting luminance level brought about by the sub-pixel 11W is high (range where the luminance level is larger than the threshold A), a chromaticity variation amount relative to a relevant variation amount of the emitting luminance level is small when the emitting luminance level varies. To put it concretely, in the sub-pixel 11W, while the emitting luminance level logarithmically varies, the chromaticity linearly varies (refer to FIG. 6B). Therefore, a chromaticity variation amount relative to a relevant variation amount of the emitting luminance level in the range of the high luminance level is smaller than in the range of the low luminance level (range where the luminance level is smaller than the threshold A). Therefore, in this range of the high luminance level, even if existing complicated chromaticity compensation is not performed, the increase of the chromaticity variation can be suppressed when images are displayed using the four color sub-pixels 11R, 11G, 11B, and 11Z (the chromaticity variation can be limited to a small amount).

In addition, in the case where the luminance level in the sub-pixel 11W is smaller than the predetermined threshold A, an output image signal is generated so that the display operation is performed respectively in the sub-pixels 11R, 11G, and 11B, but the display operation is not performed in the sub-pixel 11W, with the result that the following effect is brought about. In other words, images are displayed using the three color sub-pixels 11R, 11G, and 11B in the range of the low luminance level of the sub-pixel 11W where, if the luminance level of the sub-pixel 11W varies, a chromaticity variation amount relative to a relevant variation amount of the emitting luminance level becomes large. Therefore, in the display device and electronics apparatus according to the embodiment of the present disclosure, it is not necessary to perform color conversion processing (RGB/RGBW conversion processing) accompanied by complex chromaticity compensation. In addition, images can be displayed not using the four color sub-pixels 11R, 11G, 11B, and 11W, but using the three R, G, and B color sub-pixels in the range of the low luminance level of the sub-pixel 11W. In this case, the sufficient reduction of electricity consumption can be realized when considering the electricity consumed at the luminance levels of the four sub-pixels as a whole.

Figure 7:
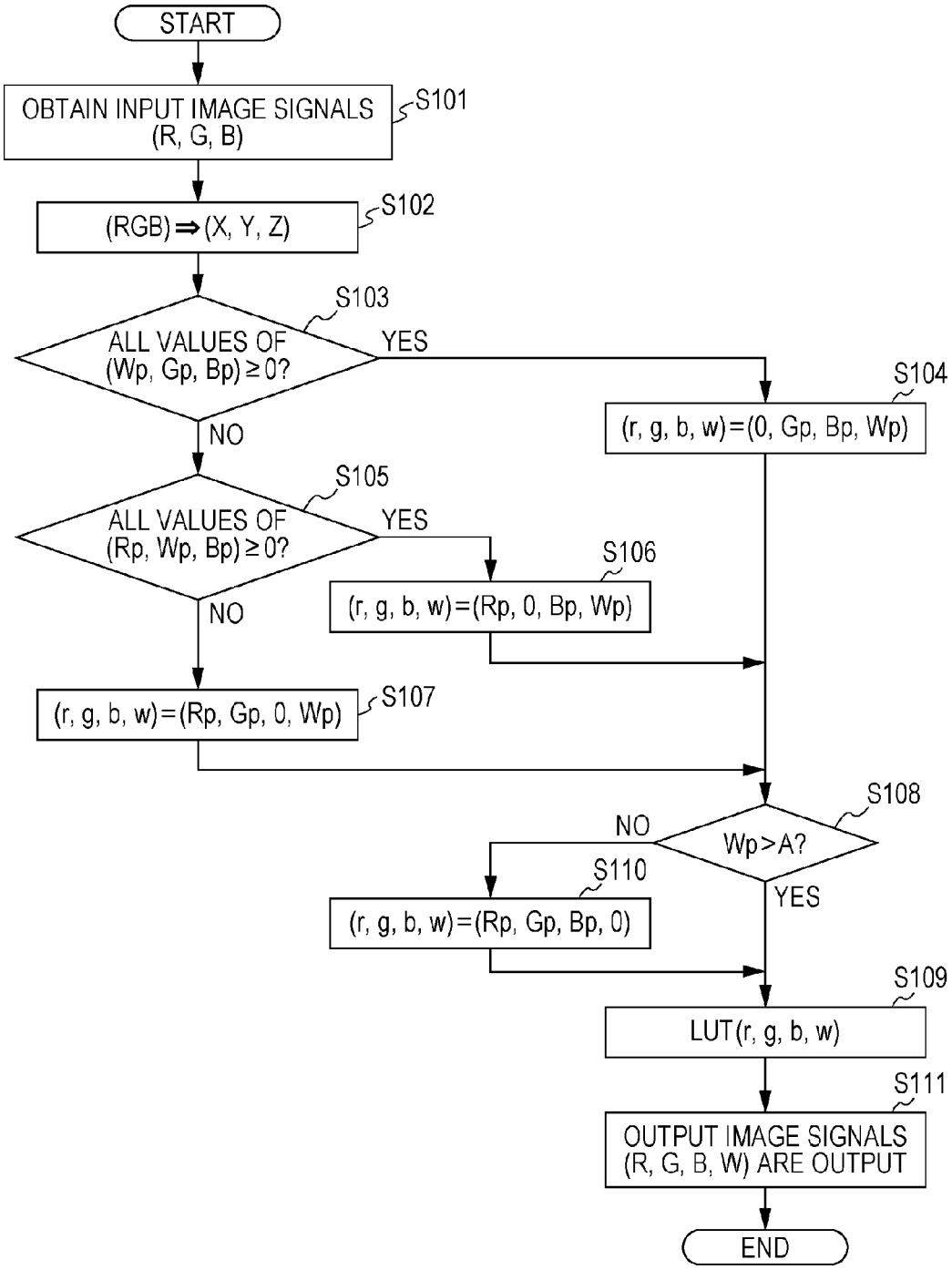
FIG. 7 is a flowchart showing an example of conversion processing performed by a conversion processing unit according to the embodiment of the present disclosure.

To put it more concretely, the conversion processing unit 210 performs conversion processing shown in FIG. 7, for example.

The conversion processing performed by the conversion processing unit 210 will be described in detail with reference to FIG. 7 hereinafter.

First, the conversion processing unit 210 obtains input image signals (R, G, B) that correspond to three colors R, G, and B (at step S101). Next, the conversion processing unit 210 converts these input image signals (R, G, B) into image signals (X, Y, Z) composed of three stimulus values X, Y, Z in a color specification system stipulated by the CIE (Commission Internationale de l'Eclairage)(at step S102). To put it concretely, first, a conversion matrix M defined by Equation (1) below is obtained on the basis of a result of measurement of R, G, and B saturated colors peculiar to the display panel 10 measured in advance. Next, with the use of an inverse matrix $M^{-1}$ of the conversion matrix M, a blend ratio (r, g, b) at the white point of the input image signals (R, G, B) is obtained by Equation (2) below. Next, with the use of this blend ratio (r, g, b), the input image signals (R, G, B) are converted into image signals (X, Y, Z) by Equation (3) and Equation (4) below. In Equations (1), (2), (3), and (4), Rx, Gx, Bx, and Wx respectively represents the values of image signals (R, G, B, W) corresponding to the stimulus value X; Ry, Gy, By, and Wy respectively represents the values of the input image signals (R, G, B, W) corresponding to the stimulus value Y; and Rz, Gz, Bz, and Wz respectively represents the values of the input image signals (R, G, B, W) corresponding to the stimulus value Z. Here, although it has been assumed that the input image signals (R, G, B) respectively represent R, G, B colors with an 8-bit or 16-bit image signal, and the intensity of each color is represented by a gamma function with the 2.2 power, for example, any function can be used as long as it defines the emitting chromaticity point and luminance of each sub-pixel. In addition, a method for converting the input image signals (R, G, B) into the image signals (X, Y, Z) is not limited to the above-described method, and other existing methods can be used. In addition, for example, plural conversion matrices allocated for plural white points can be obtained and used, or different conversion matrices obtained for individual pixels 11 or areas in the display panel 10 can be used.

$$M = \begin{pmatrix} Rx/Ry & Gx/Gy & Bx/By \\ 1 & 1 & 1 \\ Rz/Ry & Gz/Gy & Bz/By \end{pmatrix} \tag{1}$$

$$\begin{pmatrix} r \\ g \\ b \end{pmatrix} = M^{-1} \begin{pmatrix} Wx/Wy \\ 1 \\ Wz/Wy \end{pmatrix} \tag{2}$$

$$\begin{pmatrix} X \\ Y \\ Z \end{pmatrix} = \begin{pmatrix} r(Rx/Ry) & g(Gx/Gy) & b(Bx/By) \\ r & g & b \\ r(Rz/Ry) & g(Gz/Gy) & b(Bz/By) \end{pmatrix} \begin{pmatrix} \Gamma^{-1}(R) \\ \Gamma^{-1}(G) \\ \Gamma^{-1}(B) \end{pmatrix} \tag{3}$$

$$\Gamma^{-1}(x) = (x/255)^{2.2} \tag{4}$$

Next, with the use of conversion matrices Mr, Mg, and Mb defined by Equations (5) to (7) below, the conversion processing unit 210 generates converted image signals (r, g, b, w) corresponding four colors R, G, B, and W from the image signals (X, Y, Z) using Equations (8) to (10) and (11) to (13) below. To put it concretely, the conversion processing unit 210 generates three types of converted image signals in which the luminance level corresponding to R of the first type of the three converted image signals is 0 (zero); the luminance level corresponding to G of the second type is 0 (zero); and the luminance level corresponding to B of the third type is 0 (zero). In addition, the conversion processing unit 210 adopts one converted image signal whose luminance levels corresponding to R, G, B, and W are all equal to or larger than 0 (zero) from those three converted image signals. To put it concretely, first, the conversion processing unit 210 obtains image signals (Wp, Gp, Bp) from the image signals (X, Y, Z) using Equation (8) below. If all the values of these image signals (Wp, Gp, Bp) are equal to or larger than 0 (zero) (Y at step S103), image signals (0, Gp, Bp, Wp) are adopted as the image signals (r, g, b, w) (at step S104). On the other hand, if at least one of the values of the image signals (Wp, Gp, Bp) is smaller than 0 (zero) (N at step S103), the conversion processing unit 210 obtains image signals (Rp, Wp, Bp) from the image signals (X, Y, Z) using Equation (9) below. Next, if all the values of these image signals (Rp, Wp, Bp) are equal to or larger than 0 (zero) (Y at step S105), image signals (Rp, 0, Bp, Wp) are adopted as converted image signals (r, g, b, w)(at step S106). On the other hand, if at least one of the values of the image signals (Rp, Wp, Bp) is smaller than 0 (zero) (N at step S105), the conversion processing unit 210 obtains image signals (Rp, Wp, Bp) from the image signals (X, Y, Z) using Equation (10) below, and image signals (Rp, Gp, 0, Wp) are adopted as converted image signals (r, g, b, w)(at step S107).

$$Mr = \begin{pmatrix} Wx/Wy & Gx/Gy & Bx/By \\ 1 & 1 & 1 \\ Wz/Wy & Gz/Gy & Bz/By \end{pmatrix} \tag{5}$$

$$Mg = \begin{pmatrix} Rx/Ry & Wx/Wy & Bx/By \\ 1 & 1 & 1 \\ Rz/Ry & Wz/Wy & Bz/By \end{pmatrix} \tag{6}$$

$$Mb = \begin{pmatrix} Rx/Ry & Gx/Gy & Wx/Wy \\ 1 & 1 & 1 \\ Rz/Ry & Gz/Gy & Wz/Wy \end{pmatrix} \tag{7}$$

$$\begin{pmatrix} Wp \\ Gp \\ Bp \end{pmatrix} = Mr^{-1} \begin{pmatrix} Px/Py \\ 1 \\ Pz/Py \end{pmatrix} \tag{8}$$

$$\begin{pmatrix} Rp \\ Wp \\ Bp \end{pmatrix} = Mg^{-1} \begin{pmatrix} Px/Py \\ 1 \\ Pz/Py \end{pmatrix} \tag{9}$$

$$\begin{pmatrix} Rp \\ Gp \\ Wp \end{pmatrix} = Mb^{-1} \begin{pmatrix} Px/Py \\ 1 \\ Pz/Py \end{pmatrix} \tag{10}$$

$$Px = X/(X+Y+Z) \tag{11}$$

$$Py = Y/(X+Y+Z) \tag{12}$$

$$Pz = Z/(X+Y+Z) \tag{13}$$

Next, the conversion processing unit 210 judges whether, among the converted image signals (r, g, b, w) obtained as above, the luminance level corresponding to W (the value of Wp) is larger than the threshold A or not (at step S108). If Wp is larger than the threshold A (Y at step S108), these converted image signals (r, g, b, w) are adopted intact as output image signals. On the other hand, if Wp is equal or smaller than the threshold A (N at step S108), the conversion processing unit 210 obtains image signals (Rp, Gp, Bp) from the image signals (X, Y, Z) using Equation (14) below. After image signals (Rp, Gp, Bp, 0) are substituted for the converted image signals (r, g, b, w), the converted image signals (r, g, b, w) are adopted as output signals (at step S110). In other words, in this case, the image signals whose luminance level corresponding to W is 0 are adopted as the output signals.

$$\begin{pmatrix} Rp \\ Gp \\ Bp \end{pmatrix} = M^{-1} \begin{pmatrix} Px/Py \\ 1 \\ Pz/Py \end{pmatrix} \tag{14}$$

Next, with the use of, for example, a predetermined look-up table (LUT), the values of the converted image signals are converted into desired values (luminescence intensities) (at step S109), and then the final output image signals (R, G, B, W) are output (at step S111). Although it is assumed that an LUT is used for the above conversion, calculations with the use of gamma curves or approximate expressions can be used for the conversion. Alternatively, the conversion at step S109 can be omitted. The conversion processing performed by the conversion processing unit 210 shown in FIG. 7 ends after the step S111.

As described above, in this embodiment of the present disclosure, when the conversion processing unit 210 generates output image signals corresponding to the four colors R, G, B, and W on the basis of input image signals corresponding to the three colors R, G, and B, the following conversion processing is performed. To put it concretely, the conversion processing unit 210 generates output image signals so that display operation is respectively performed in the sub-pixels 11R, 11G, 11B, and 11W if the luminance level of the sub-pixel 11W is higher than a predetermined threshold A. On the other hand, if the luminance level of the sub-pixel 11W is equal to or lower than the predetermined threshold A, the conversion processing unit 210 generates output image signals so that the display operation is respectively performed in the sub-pixels 11R, 11G, and 11B, but the display operation is not performed in the Z sub-pixel 11W. Therefore, even if existing complicated chromaticity compensation is not performed, the increase of the chromaticity variation can be suppressed when images are displayed. As a result, this embodiment of the present disclosure is capable of bringing images of high quality into shape while suppressing the increase of the load of signal processing when images are displayed using a sub-pixel structure having four R, G, B, and Z color sub-pixels. In addition, in this case, electricity consumption can be more lowered than in the case where images are displayed using pixels each having a sub-pixel structure composed of three R, G, and B sub-pixels.

In addition, in this embodiment of the present disclosure, it is conceivable that, in order to alleviate a color shift that occurs at the junction between the driven area and the non-driven area of the sub-pixel 11W, a technique in which the intensity of the emitting luminance level of W (white color) allocated for the portions of the sub-pixel 11W that have the luminance level almost equal to the threshold A is gradually changed is employed.

<Modified Example>

Next, a modified example of the above embodiment will be described. Components in this modified example that have effectively the same functional configuration as those in the above embodiment are indicated by the same reference numerals, and repeated description is avoided accordingly.

Figure 8A:
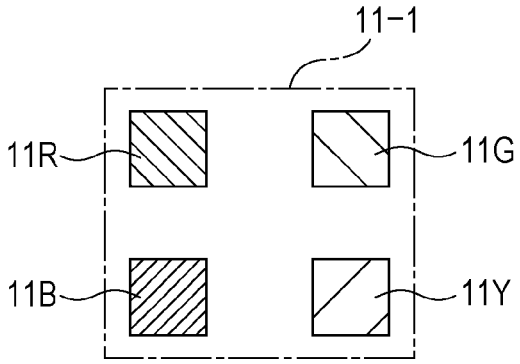
FIG. 8A is a schematic diagram showing an example of a sub-pixel structure in one pixel according to a modified example.
Figure 8B:
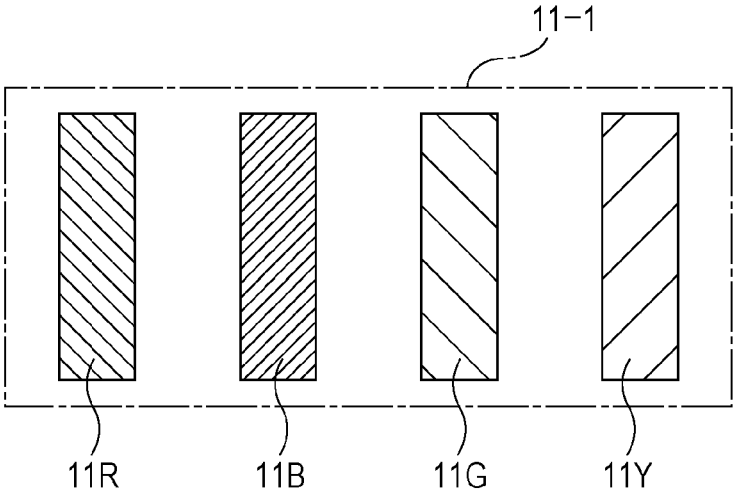
FIG. 8B is a schematic diagram showing another example of a sub-pixel structure in one pixel according to a modified example.

FIG. 8A is a plan view that schematically shows an example of an internal configuration (sub-pixel structure) in a pixel 11-1 of the modified example. FIG. 8B is a plan view that schematically shows another example of an internal configuration (sub-pixel structure) in a pixel 11-1 of the modified example.

Each pixel 11-1 of this modified example includes three primary-color sub-pixels, that is, a R sub-pixel 11R, a G sub-pixel 11G, a B sub-pixel 11B, and one color Z sub-pixel (in this case, a yellow (Y) sub-pixel) whose luminance is higher than luminances of the above three sub-pixels. In other words, each pixel 11-1 has a sub-pixel structure composed of four sub-pixels 11R, 11G, 11B, and 11Y that respectively correspond to four colors R, G, B, and Y. In other words, the pixel 11-1 of this modified example is equivalent to the pixel 11 of the above-described embodiment, except that the pixel 11-1 includes the sub-pixel 11Y corresponding to Y instead of the sub-pixel 11W corresponding to W that the pixel 11 includes.

An example shown in FIG. 8A, just like that shown in FIG. 2A, has the four sub-pixels 11R, 11G, 11B, and 11Y that are disposed in a matrix configuration (2-by-2 matrix configuration) in a pixel 11-1. An example shown in FIG. 8B, just like that shown in FIG. 2B, has the four sub-pixels 11R, 11G, 11B, and 11Y that are disposed in a row configuration in a pixel 11-1. However, a configuration in which the four sub-pixels 11R, 11G, 11B, and 11Y are disposed in a pixel 11-1 is not limited to either one of the above configurations, and it can be any other configuration.

Here, each of the four sub-pixels 11R, 11G, 11B, and 11W includes an organic EL element 12 that emits white light Lw (white light emitting element) just like the four sub-pixels 11R, 11G, 11B, and 11W in the above-described embodiment does. In addition, color filters (not shown) corresponding to the colors R, G, B, and Y are respectively provided to the sub-pixels 11R, 11G, 11B, and 11Y. Alternatively, it is conceivable that a yellow light emitting element formed by laminating a green light emitting layer 441G and a red light emitting layer 441R is provided in the sub-pixel 11Y without the color filter corresponding to Y being provided.

This modified example having such a configuration as above can also provide effects similar to those provided by the above-described embodiment of the present disclosure. In other words, the color Z sub-pixel whose luminance is higher than luminances of the three primary-color R, G, and B sub-pixels can be not only the W sub-pixel described in the above embodiment, but also the Y sub-pixel described in the above modified example or other color sub-pixels.

MODULE AND APPLICATION EXAMPLES

Next, application examples to which the display device described in the above embodiment or in the above modified example is applied will be described with reference to FIG. 9 to FIG. 14G. The display device 1 according to the above embodiment and the like can be applied to all kinds of electronics apparatuses such as television sets, digital cameras, laptop personal computers, mobile terminal devices (for example, cellular phones), video cameras, and the like. In other words, this display device 1 can be applied to electronics apparatuses in all kinds of fields that display image signals supplied from outside or created inside as graphics or images.

(Module)

Figure 9:
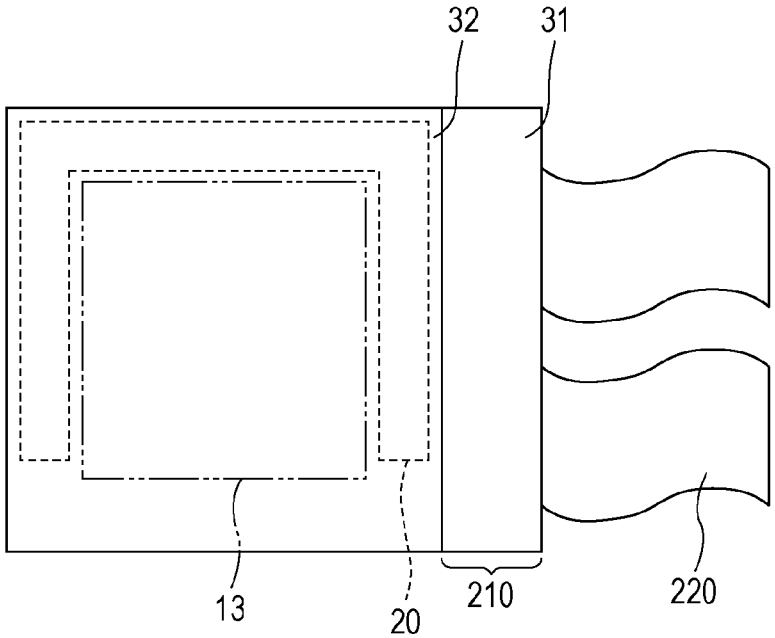
FIG. 9 is a plan view showing a schematic configuration of a module including a display device according to the embodiment or the modified example of the present disclosure.

The display device 1 can be built into a module as shown in FIG. 9, for example, and the module can be mounted on various electronics apparatuses such as application examples 1 to 5 which will be described later. This module shown in FIG. 9 includes, for example, a substrate 31 that has an exposed area 210 extended from an encapsulating substrate 32 on its one side, and an external connection terminal (not shown) which is formed on this exposed area 210 and to which wires extended from a drive circuit 20 is connected. A flexible printed circuit (FPC) substrate 220 can be connected to this external connection terminal.

Application Example 1

Figure 10:
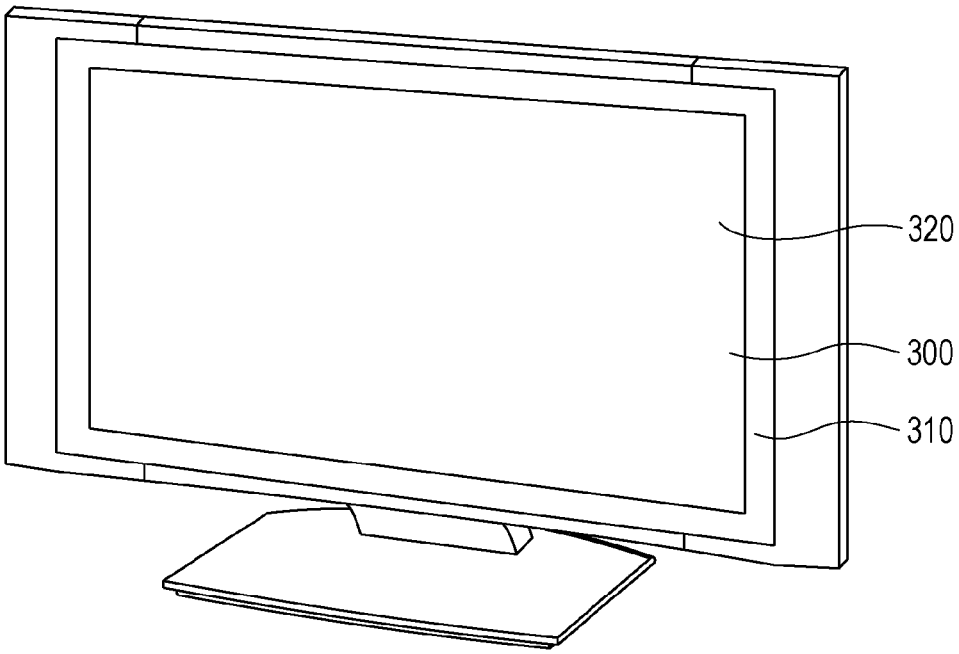
FIG. 10 is a perspective view showing an exterior appearance of an application example 1 of the display device according to the embodiment or the modified embodiment.

FIG. 10 shows an exterior appearance of a television set to which the display device 1 is applied. This television set is equipped with, for example, an image display screen unit 300 including a front panel 310 and a filter glass 320, and this image display screen unit 300 includes the display device 1.

Application Example 2

Figure 11A:
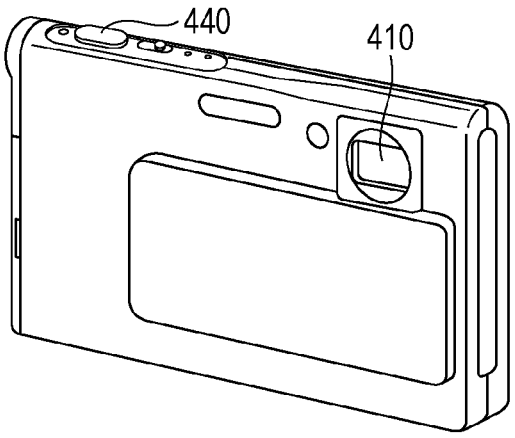
FIG. 11A is a perspective view showing an exterior appearance of an application example 2 viewed from the front.
Figure 11B:
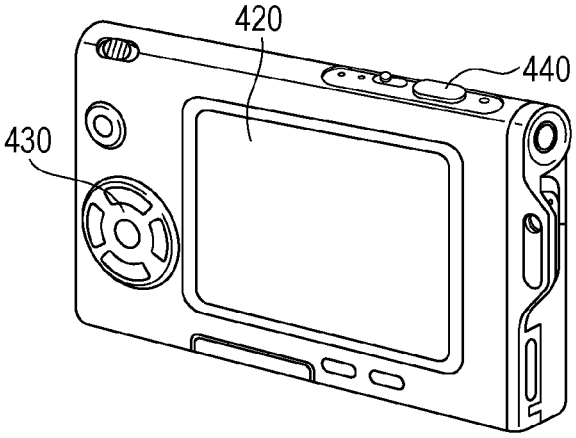
FIG. 11B is a perspective view showing an exterior appearance from the back.

FIG. 11A and FIG. 11B show exterior appearances of a digital camera to which the display device 1 is applied. This digital camera is equipped with, for example, a light emitting unit 410 for a photoflash, a display unit 420, a menu switch 430, and a shutter button 440, and this display unit 420 includes the display device 1.

Application Example 3

Figure 12:
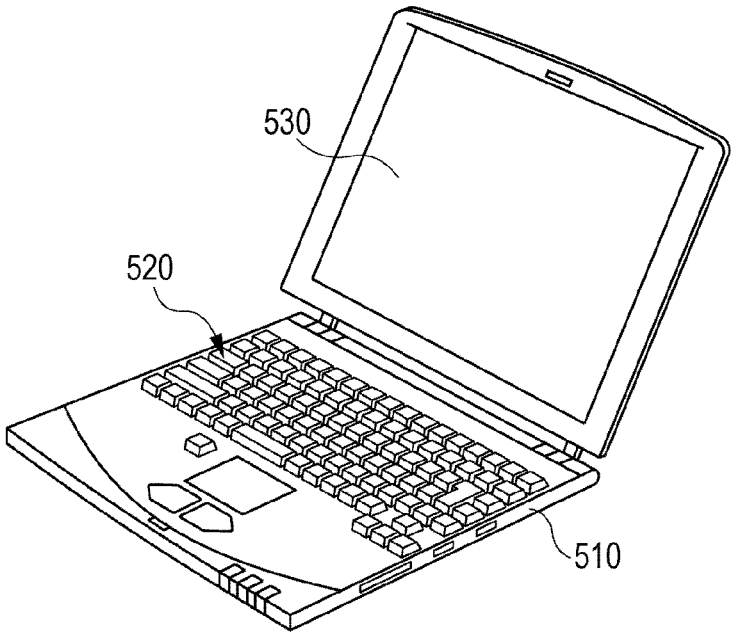
FIG. 12 is a perspective view showing an exterior appearance of an application example 3.

FIG. 12 shows an exterior appearance of a laptop personal computer to which the display device 1 is applied. This laptop personal computer is equipped with, for example, a main body 510, a keyboard 520 for input operation of characters and the like, and a display unit 530 for displaying images, and this display unit 530 includes the display device 1.

Application Example 4

Figure 13:
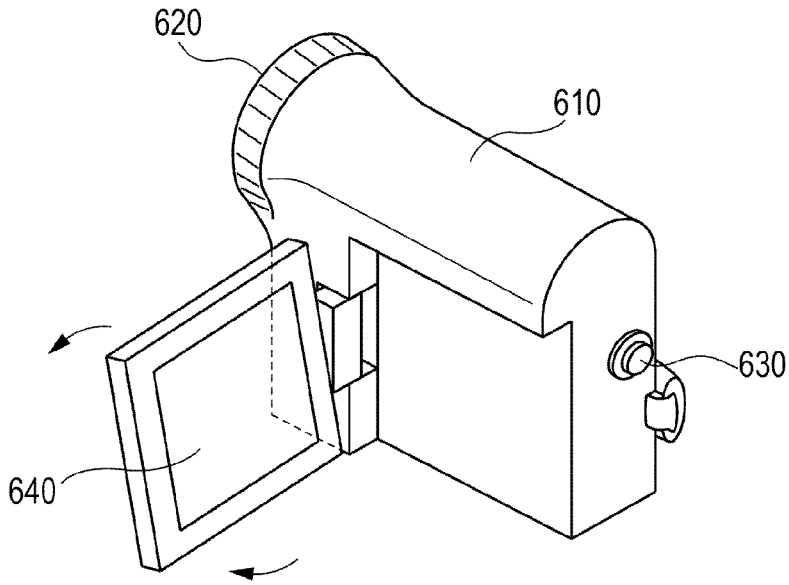
FIG. 13 is a perspective view showing an exterior appearance of an application example 4.
Figure 14A:
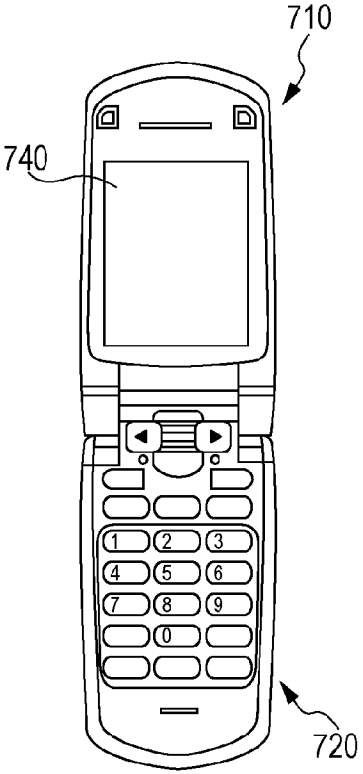
FIG. 14A is a front view of an application 5 with its body open.
Figure 14B:
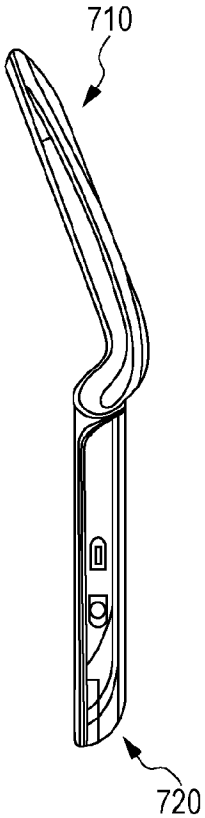
FIG. 14B is a side view of the application 5 with its body open.
Figure 14D:
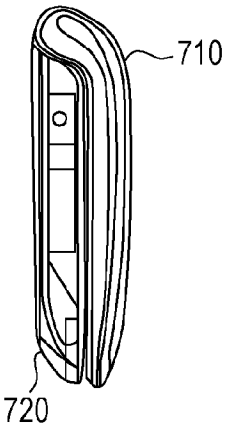
FIG. 14D is a left side view of the application 5 with its body closed.
Figure 14C:
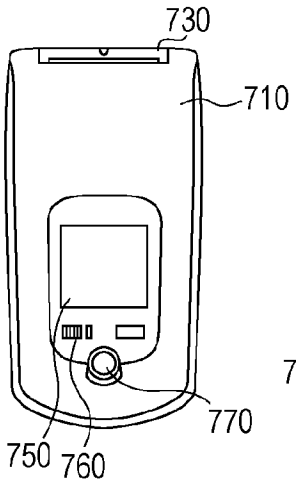
FIG. 14C is a front view of the application 5 with its body closed.
Figure 14E:
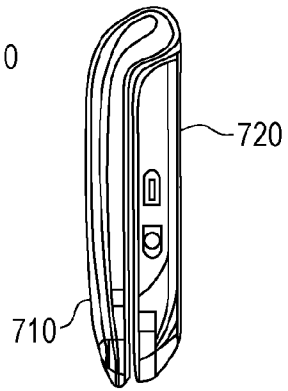
FIG. 14E is a right side view of the application 5 with its body closed.
Figure 14F:
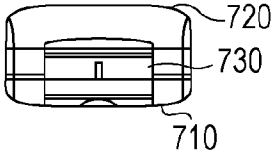
FIG. 14F is a top view of the application 5 with its body closed.
Figure 14G:
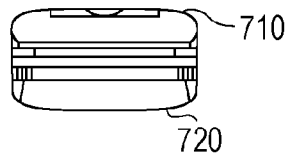
FIG. 14G is a bottom view of the application 5 with its body closed.

FIG. 13 shows an exterior appearance of a video camera to which the display device 1 is applied. This video camera is equipped with, for example, a main body 610, a lens 620 that is mounted on the front side of this main body 610 and used for photographing an object, a start/stop switch 630 for photographing, and a display unit 640, and this display unit 640 includes the display device 1.

Application Example 5

FIG. 14A to FIG. 14G show exterior appearances of a cellular phone to which the display device 1 is applied when the cellular phone is in various states.

This cellular phone has, for example, a configuration in which an upper chassis 710 and a lower chassis 720 are connected with a connection (hinge) 730, and is equipped with a display 740, a sub-display 750, a picture light 760, and a camera 770. Among these components, the display 740 or a sub-display 750 includes the display device 1.

Other Modification Examples

Although the embodiment, the modified example, and the application examples of the present disclosure have been described above, the present disclosure is not limited the above-described embodiment and the like, and the present disclosure may be embodied in various modifications.

For example, in the above-described embodiment and the like, the description about the organic EL element 12 is mainly made under the assumption that the organic EL element 12 is a white light emitting element including a white light emitting layer 441W, but for example, the organic EL elements 12 inside the sub-pixels 11R, 11G, and 11B can be organic EL elements that respectively emit lights corresponding to colors R, G, and B. In addition, the structure of the white light emitting layer 441W can be formed so that plural emitting layers that have emitting lights different from each other are not laminated, but disposed along the in-plane direction in a pixel. In addition, in the above-described embodiment and the like, although the description has been made under the assumption that a light emitting element is an organic EL element, light emitting elements other than the organic EL element can be used.

In addition, in the above-described embodiment and the like, although the description has been made under the assumption that the display device 1 is an active matrix type display device and is driven by the pixel circuit 14 shown in FIG. 3, the configuration of the pixel circuit 14 to drive the display device 1 is not limited to the configuration that has been described with reference to FIG. 3. In other words, the configuration of the pixel circuit 14 is not limited to the "2Tr1C" circuit configuration. For example, if necessary, a capacitive element, a transistor, or the like can be added to the pixel circuit 14 shown in FIG. 3, or the capacitive element, the transistors, or the like used in the pixel circuit 14 shown in FIG. 3 can be replaced with other electronics elements. In the above case, on the basis of modifications of the pixel circuit 14, drive circuits other than the above-described scanning line drive circuit 23, signal line drive circuit 24, and power line drive circuit 25 can be added to the display device 1 if necessary.

In addition, in the above-described embodiment and the like, although the description has been made under the assumption that drive operations of the scanning line drive circuit 23, signal line drive circuit 24, and power line drive circuit 25 are controlled by the timing generation circuit 22, these drive operations can be set to be controlled by another circuit. Such control over the scanning line drive circuit 23, signal line drive circuit 24, and power line drive circuit 25 can be performed by hardware (by a circuit), or by software (by a program).

In addition, in the above-described embodiment and the like, although the description has been made under the assumption that the write transistor Tr1 and drive transistor Tr2 are both n-channel transistors (for example, n-channel MOS TFTs), but the write transistor Tr1 and drive transistor Tr2 are not limited to n-channel transistors. In other words, the write transistor Tr1 and drive transistor Tr2 can be p-channel transistors (for example, p-channel MOS TFTs).

The present disclosure contains subject matter related to that disclosed in Japanese Priority Patent Application JP 2011-056690 filed in the Japan Patent Office on Mar. 15, 2011, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a display unit that has a plurality of pixels each including three color sub-pixels, that is, a red (R) sub-pixel, a green (G) sub-pixel, and a blue (B) sub-pixel, and a color (Z) sub-pixel whose luminance is higher than luminances of the above three sub-pixels;

a conversion processing unit that generates output image signals corresponding to the four colors R, G, B, and Z by performing predetermined processing on the basis of input image signals corresponding to the three colors R, G, and B; and a drive unit that is equipped with the conversion processing unit and performs display driving on the R sub-pixel, G sub-pixel, B sub-pixel, and Z sub-pixel using the output signals, wherein the conversion processing unit generates the output image signals so that display operation is respectively performed in the R, G, B, and Z sub-pixels if the luminance level of the Z sub-pixel is higher than a predetermined threshold; and generates the output image signals so that the display operation is performed respectively in the R, G, and B sub-pixels, but the display operation is not performed in the Z sub-pixels if the luminance level of the Z sub-pixel is equal to or lower than the predetermined threshold.

2. The display device according to claim 1, wherein the conversion processing unit generates converted image signals corresponding to the four colors R, G, B, and Z on the basis of the input image signals;

outputs the converted image signals as the output image signals if, among the luminance levels of the converted image signals, the luminance level of the converted signal corresponding to the color Z is higher than the threshold; and generates, on the other hand, the output image signals so that the luminance level of the converted signal corresponding to the color Z becomes 0 (zero) with the chromaticity point of the color Z kept intact on the basis of the input image signals if, among the luminance levels of the converted image signals, the luminance level of the converted signal corresponding to the color Z is equal to or lower than the threshold.

3. The display device according to claim 2, wherein the conversion processing unit generates three types of converted image signals, wherein the luminance level corresponding to R of the first type of the three converted image signals is 0 (zero), the luminance level corresponding to G of the second type is 0 (zero), and the luminance level corresponding to B of the third type is 0 (zero); and adopts, from those three converted image signals, one converted image signal whose luminance levels corresponding to R, G, B, and Z are all equal to or larger than 0 (zero).

4. The display device according to claim 1, wherein the threshold is set so that a chromaticity variation amount corresponding to a chromaticity point at the time when the Z sub-pixel shows the maximum luminance level is within a predetermined range.

5. The display device according claim 1, wherein the conversion processing unit does not perform chromaticity compensation on the image signal corresponding to the color Z at the time of conversion processing.

6. The display device according claim 1, wherein each pixel includes the R, G, and B sub-pixels, and a white (W) sub-pixel as the Z sub-pixel.

7. The display device according to claim 6, wherein color filters corresponding to the colors R, G, and B one-by-one are respectively allocated to the three sub-pixels, while a color filter is not allocated to the W sub-pixel.

8. The display device according to claim 7, wherein each of the R, G, B, and W sub-pixels has a white light emitting element.

9. The display device according to claim 8, wherein the white light emitting element includes a plurality of light emitting layers which emit different types of light.

10. The display device according to claim 8, wherein the white light emitting element is an organic EL element.

11. An electronics apparatus comprising a display device, the display device including:

a display unit that has a plurality of pixels each including three color sub-pixels, that is, a red (R) sub-pixel, a green (G) sub-pixel, and a blue (B) sub-pixel, and a color (Z) sub-pixel whose luminance is higher than luminances of the above three sub-pixels;

a conversion processing unit that generates output image signals corresponding to the four colors R, G, B, and Z by performing predetermined processing on the basis of input image signals corresponding to the three colors R, G, and B; and a drive unit that is equipped with the conversion processing unit and performs display driving on the R sub-pixel, G sub-pixel, B sub-pixel, and Z sub-pixel using the output signals, wherein the conversion processing unit generates the output image signals so that display operation is respectively performed in the R, G, B, and Z sub-pixels if the luminance level of the Z sub-pixel is higher than a predetermined threshold; and generates the output image signals so that the display operation is respectively performed in the R, G, and B sub-pixels, but the display operation is not performed in the Z sub-pixel if the luminance level of the Z sub-pixel is equal to or lower than the predetermined threshold.

* * * * *